United States Patent [19]

Kleve

[11] 4,364,195

[45] Dec. 21, 1982

[54] DOLL WITH CLOSING EYES

[75] Inventor: Mary Kleve, New York, N.Y.

[73] Assignee: Ned Strongin Associates, Inc., New York City, New York

[21] Appl. No.: 277,133

[22] Filed: Jun. 25, 1981

[51] Int. Cl.[3] ..... A63H 11/00

[52] U.S. Cl. ..... 46/135 R

[58] Field of Search ..... 46/135 R, 165, 167, 46/151, 158, 164, 115

[56] References Cited

U.S. PATENT DOCUMENTS 1,419,136 6/1922 Hauck ..... 46/135 R 2,289,977 7/1942 Maibaum ..... 46/135 R

FOREIGN PATENT DOCUMENTS 248087 3/1926 Italy ..... 46/135 R 304512 1/1929 United Kingdom ..... 46/135 R

*Primary Examiner*—Mickey Yu

*Attorney, Agent, or Firm*—Edward F. Levy

[57] ABSTRACT

A doll with closing eyes includes a head having a front fabric panel which is mounted superimposed on a base fabric panel. The front panel includes a pair of cut-out portions which resemble eye orbits. An eye panel which has indicia depicting a pair of open eyes and a pair of closed eyes is slideably disposed between the front and base panels. A ribbon is attached to the eye panel and passes through slots formed in the front fabric panel enabling a child to pull on the ribbon and move the eye panel so that either the pair of closed eyes or the pair of open eyes is visible through the cut-out portions in the front fabric panel.

8 Claims, 5 Drawing Figures

FIG. 3
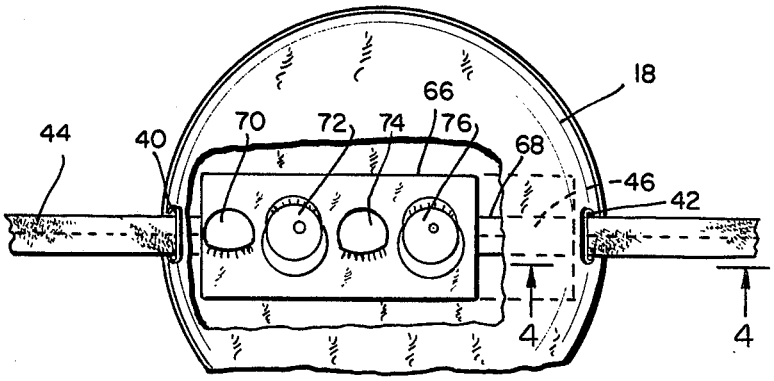
FIG. 5
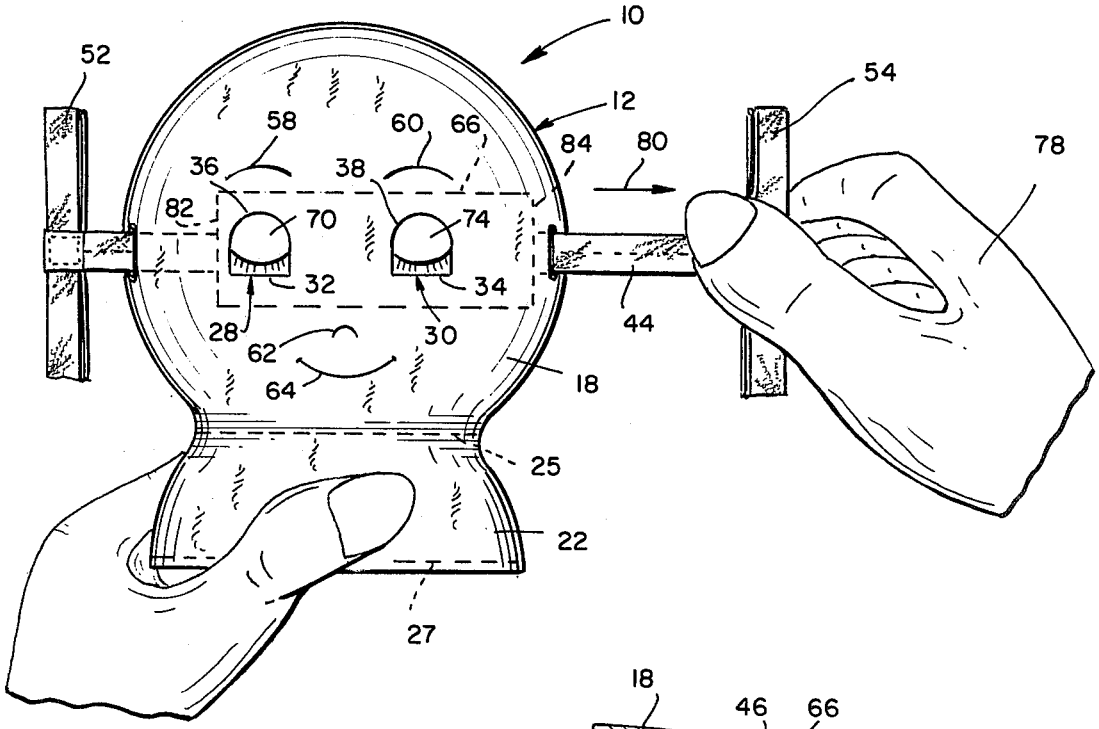
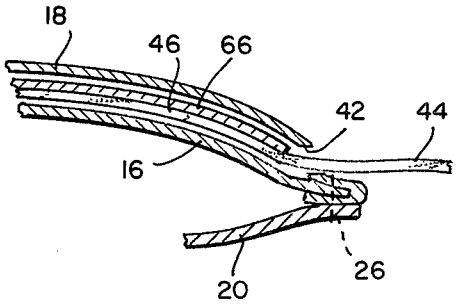
FIG. 4

DOLL WITH CLOSING EYES

In the development of dolls there has been an ongoing desire to incorporate a capability for action or animation to enhance the realism and play value of the doll and thereby extend the interest and involvement of children. This has led to the development of dolls having complex mechanisms formed of a wide variety and large quantity of moving parts. Among the results of this development trend have been constantly increasing cost and reduced ruggedness and reliability.

This desire for action and movement of the doll has also led to a trend away from the traditional stuffed doll construction because it has been too difficult to incorporate a capability for action in such dolls.

It is an object of the present invention to overcome the deficiencies of the prior art by providing a doll with closing eyes which has a simple and rugged construction.

Another object of the present invention is to provide a doll with closing eyes which has a flexible stuffed construction.

Still another object of the present invention is to provide a doll with closing eyes having a small number of component parts, each of which are relatively simple in construction, thereby resulting in a relatively low overall cost.

In accordance with the present invention there is provided a doll with closing eyes which comprises a head portion having a front fabric panel which is mounted superimposed on a base fabric panel, and also having a back panel. The marginal edges of the front, base and back panels are stitched together to form an envelope which is stuffed with a soft resilient material positioned between the base and the back panels. The front panel includes a pair of cut-out portions which resemble eye orbits. The front panel also includes indicia depicting eye brows, a nose and a mouth so that the front panel has the overall appearance of a human face. An eye panel is slidably disposed between the front panel and the base panel. The eye panel has indicia depicting a pair of open eyes and a pair of closed eyes. An intermediate portion of a fabric ribbon is connected to the eye panel and end portions of the ribbon pass to the outside of the front panel through a pair of slots formed, one each, on either side of the pair of cut-out portions.

In use, a child can grasp an end of the fabric ribbon and selectively move the eye panel between a first position in which the indicia depicting open eyes are in alignment with the cut-out eye portions, and a second position in which the indicia depicting closed eyes are in alignment with the cut-out eye portions.

Additional objects and advantages of the present invention will become apparent during the course of the following specification when taken in connection with the accompanying drawings in which:

FIG. 3 is a fragmentary front elevational view similar to FIG. 1, with a portion shown broken away to reveal details of internal construction;

FIG. 4 is a fragmentary sectional view taken along line 4—4 of FIG. 3; and

FIG. 5 is a front elevational view similar to FIG. 1, showing the manner in which the eye assembly is moved to its closed position.

Figure 1:
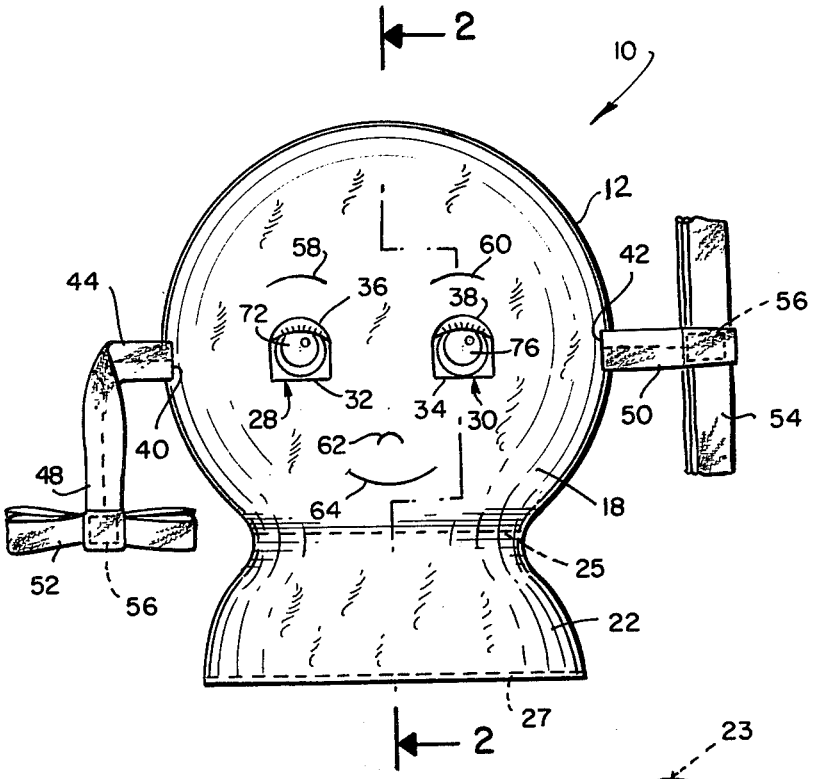
FIG. 1 is a front elevation view of the head portion of a doll with closing eyes made in accordance with the present invention.

Referring in detail to the drawings, there is shown in FIG. 1 a stuffed doll head 10 having a closing eye feature, made in accordance with the present invention, and adapted to be mounted on a doll body. The doll head 10 comprises a flexible fabric container 12 generally shaped to resemble a human head and filled with a stuffing 14 of wool, shredded foam or similar material. The container 12 comprises a base panel 16, a front panel 18, a rear panel 20, a lower front panel 22 and a lower rear panel 24. The base panel 16, front panel 18 and rear panel 20 are of substantially circular shape and are secured together to form the head portion of the doll. The lower front and rear panels 22 and 24 are similarly secured together and joined to the head portion to form an enclosed neck portion of the doll which depends from the head portion and communicates with the interior of the latter. The stuffing 14 fills the interiors of both the head and neck portions.

Figure 2:
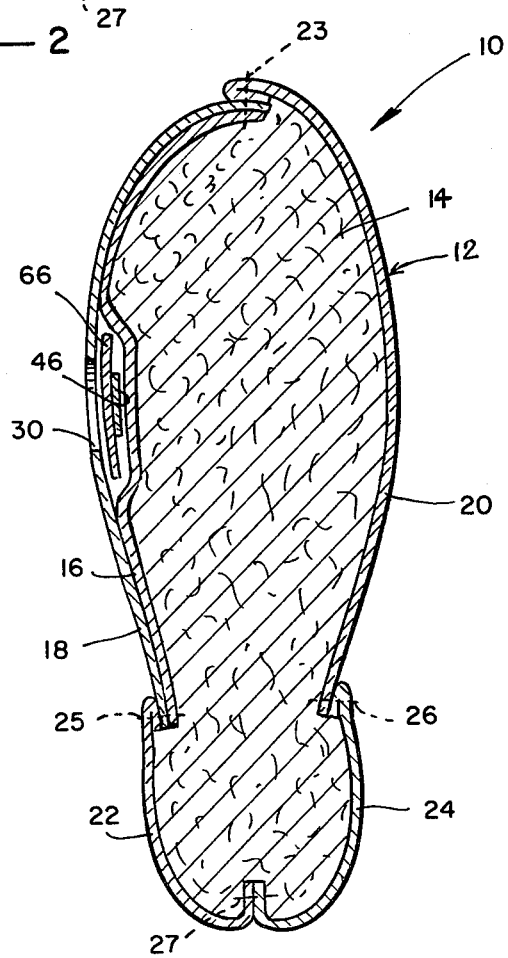
FIG. 2 is a sectional taken along line 2—2 of FIG. 1.

As shown in FIG. 2, the front panel 18 and base panel 16 are secured together around their peripheries by a line of stitching 23, which also joins the panels 16, 18 to the rear panel 20. At their lower ends, the front panel 18 and base panel 16 are secured together and to the top edge of the lower front panel 22 by a line of stitching 25. The lower end of the rear panel 20 is secured to the top edge of lower rear panel 24 by a line of stitching 26, and the remainder of the peripheries of the lower front and rear panels 22 and 24 are secured together by a line of stitching 27.

The panels 16, 18, 20, 22 and 24 may be made of fabric, flexible plastic film or a similar suitable material. When the doll head is assembled and stuffed, as shown in FIG. 2, the front panel 18 and base panel 16 are disposed in flush abutment to provide a double-panel front wall constituting the face of the doll head.

As is shown in FIGS. 1 and 5 the front panel 18 is formed with a pair of cut-out apertures 28, 30 which resemble eye orbits. The apertures 28, 30 are defined by bottom horizontal straight edges 32 and 34 and respective arch-like curved upper portions 36, 38. The front panel 18 also includes a pair of vertical slots 40, 42 disposed, one each, on opposite sides of the apertures 28, 30. These vertical slots 40, 42 are sized for the slidable reception of a fabric ribbon 44, an intermediate portion 46 of which extends through the slots 40, 42 and is disposed behind the front panel 18 and in front of the base panel 16 as is shown in FIGS. 2 and 4. The ends 48, 50 of the ribbon 44 include bows 52, 54 which are attached by stitching 56 or similar means. The bows 52, 54 and the ribbon 44, in combination, generally resemble pigtails for the doll head.

The front panel 18 includes indicia depicting eye brows 58, 60, a nose 62 and a mouth 64 so that the overall appearance of the front panel 18 generally resembles a human face.

A rectangular panel 66 is attached to the intermediate portion of the ribbon 44, as shown in FIGS. 2 and 3. The panel 66 is of appreciably greater width than the ribbon 44, and has printed or painted thereon indicia representing a spaced pair of closed eyes 70 and 74 and an alternating pair of spaced open eyes 72 and 76. As viewed from left to right in FIG. 3, these eye indicia are arranged in the following order: a first closed eye 70, a first open eye 72, a second closed eye 74 and a second open eye 76. The spacing between the centers of the pair of closed eyes 70, 74 is the same as the spacing between the centers of the pair of open eyes 72, 76, as well as between the centers of the apertures 28, 30. The eye indicia 70, 72, 74 and 76 may be formed by silk screen printing or similar suitable means. The rectangular panel 66 may be made of a relatively stiff fabric or similar material.

Because of the aforementioned spacing of the eye pairs 70, 74 and 72, 76 in conformity with the spacing between the eye apertures 28, 30, it will be apparent that when the ribbon 44 and its attached rectangular panel 66 are slid relative to the doll head in one direction, the pair of open eyes 72, 76 will register with the eye apertures 28, 30 and the doll will appear to be awake as shown in FIG. 1. When the ribbon 44 and the rectangular panel 66 are slid in the opposite direction, the closed eyes 70, 74 will move into registry with the eye apertures 28, 30, as shown in FIG. 5, and the doll will appear to be asleep.

In use, with the doll head in the "awake" condition shown in FIG. 1, a child grasps the projecting right end of the ribbon 44 by the bow 54, with one hand 78, as shown in FIG. 5, and pulls the ribbon 44 to the right in the direction of the arrow 80. This moves the panel 66 from the state, shown in FIG. 1, in which the indicia depicting open eyes 72, 76 are in registry with the apertures 28, 30, to the state, shown in FIG. 5, in which the indicia depicting closed eyes 70, 74 are in registry with the apertures 28, 30. The edges 82, 84 of the relatively wide panel 66 act as stops abutting the portions of the front panel 18 adjacent the slots 40, 42 and prevent excessive motion of the ribbon 44 when pulled either to the right or to the left. The edges 82 and 84 are also positioned to stop movement of the panel 66 in both directions at the precise point in which the respective pairs of eyes register with the eye aperture, thereby enabling a child to easily align the eyes on the panel 66 with the eye apertures 28, 30.

The various components of the doll 10 according to the invention are preferably made of fabric or similar material, the surface of which has a relatively high coefficient of friction. Friction between the panel 66 and the front and base panels 16, 18 and friction between the ribbon 44 and the front and base panels 16, 18 ensures that the position of the panel 66 relative to the apertures 28, 30 is maintained until it is changed by the child. This frictional force is augmented by the stuffing 14 within the doll head, which maintains the base panel 16 pressed tightly against the front panel 18 with the rectangular panel compressed firmly therebetween.

While a preferred embodiment of the invention has been shown and described herein, it is obvious that numerous omissions, changes and additions may be made in such embodiment without departing from the spirit and scope of the invention.

What is claimed is:

1. A doll with closing eyes comprising a head portion including a base panel and a rear panel, connection means interconnecting marginal edges of said base panel and said rear panel to form an envelope, filler means disposed in said envelope and constituting a stuffing for said head portion, a front panel overlying said base panel in flush abutment therewith, said front panel having a pair of spaced apart eye apertures simulating eye orbits, an eye panel slidably disposed between said base panel and said front panel, said eye panel being formed with indicia depicting a spaced pair of closed eyes and a spaced pair of open eyes, an actuation strip mounted on said eye panel and having end portions projecting from said doll head portion and being manually movable relative to said head portion to enable an operator to move said eye panel selectively between a first position in which said open eye indicia are in registry with said eye apertures, and a second position in which said closed eye indicia are in registry with said eye apertures, and a pair of slots formed in said front panel with a slot disposed on either side of said pair of apertures, said actuation strip comprising a flexible ribbon member having an intermediate portion connected to said eye panel and end portions passing outward of said front panel through said slots.

2. A doll according to claim 1 in which the marginal edges of said front panel are connected to said base panel by said connection means.

3. A doll according to claim 1 in which said connecting means comprises stitching.

4. A doll according to claim 1 in which said filler material comprises shredded resilient foam.

5. A doll according to claim 1 in which said base panel, said front panel and said eye panel are each made of fabric.

6. A doll according to claim 1 in which said ribbon member is made of fabric.

7. A doll according to claim 6 in which end portions of said ribbon member include bows.

8. A doll according to claim 1 in which said front panel further includes indicia depicting eye brows, a nose and a mouth.

* * * * *